United States Patent [19]

Houk

[11] 4,422,783

[45] Dec. 27, 1983

[54] STAMPING APPARATUS HAVING MAGNETIC SUPPORTING MEANS

[75] Inventor: LeRoy E. Houk, Ellwood, Pa.

[73] Assignee: The Babcock & Wilcox Company, New Orleans, La.

[21] Appl. No.: 458,681

[22] Filed: Jan. 17, 1983

Related U.S. Application Data

[63] Continuation of Ser. No. 217,307, Dec. 17, 1980, abandoned.

[51] Int. Cl.[3] ..... B41J 1/16

[52] U.S. Cl. ..... 400/128; 400/140; 101/4; 101/29; 101/41

[58] Field of Search ..... 101/19, 26, 4, 35, 41, 101/42, 28, 29; 400/140, 141, 128

[56] References Cited

U.S. PATENT DOCUMENTS

| | | | |
|---|---|---|---|
| 710,257 | 9/1902 | De Leeuw | 408/76 |
| 1,118,998 | 12/1914 | Authier | 400/141 |
| 1,334,758 | 3/1920 | Horton | 400/141 |
| 2,271,500 | 1/1942 | Rickenbach | 101/28 |
| 2,545,711 | 3/1951 | Speicher | 101/28 |
| 2,654,311 | 10/1953 | Costanzo | 101/41 |
| 2,655,099 | 10/1953 | Rickenbach | 101/28 |
| 3,351,003 | 11/1967 | McCoy | 101/29 |
| 3,405,633 | 10/1968 | Price, Jr. et al. | 101/37 |
| 3,557,689 | 1/1971 | Teplitz | 101/35 |
| 3,596,967 | 8/1971 | Carter | 294/65.5 |

*Primary Examiner*—Edgar S. Burr
*Assistant Examiner*—David A. Wiecking
*Attorney, Agent, or Firm*—James A. Hudak; Vytas R. Matas; Robert J. Edwards

[57] ABSTRACT

A holder (10) for stamps (20) used to imprint identifying characters into the surface of a material which can be magnetized. The holder includes a frame (12) having a channel (18) formed therein to receive the stamps, which are held in place therein by means of a rod (28) which is received through holes (34, 36) formed in end plates (30, 32) attached to the frame, and through groves (24) formed in the stamps. A punch (66) held by a cylindrical holder (60) is inserted in holes (58) formed in the frame above the stamps and is struck by a hammer or the like to imprint the characters formed on the stamps into the surface. The holder is held in position on the surface by means of magnets (46, 48) which are adjustably attached to support assemblies (14, 16) attached to the end plates.

5 Claims, 3 Drawing Figures

STAMPING APPARATUS HAVING MAGNETIC SUPPORTING MEANS

This is a continuation of application Ser. No. 217,307, filed Dec. 17, 1980, now abandoned.

TECHNICAL FIELD

The present invention relates generally to stamping devices, and particularly to a device for stamping identifying characters into a metal surface.

BACKGROUND ART

In the production of metal products it is often necessary to permanently stamp important information into the surface of the product. For example, large metal tubes or pipes used in the power generation industry must have a series of characters permanently imprinted therein for identification purposes. Such identifying characters are generally applied by hardened stamps similar in appearance to printing type, but capable of being punched into the metal surface. Each stamp can include one or more characters, and are struck directly by a hammer or the like to punch the character or set of characters into the metal. Where the identification must include a series of individual characters, however, aligning and punching in the characters individually can be a time consuming process, and it is difficult to maintain uniform spacing and alignment of the characters. Devices for holding several individual stamps are known; however, they are generally designed to imprint all the characters at once, and particularly when imprinting steel piping it is difficult to obtain a sufficiently deep imprint.

Another problem associated with prior art devices is that of positioning a stamp holder on a rounded surface such as a large steel pipe.

SUMMARY OF THE INVENTION

The present invention provides a holder for a plurality of stamps which is capable of being retained in position for stamping on any surface capable of being magnetized, including cylindrical surfaces. The holder includes means for receiving a plurality of stamps and for retaining them within the holder, and means permitting each stamp to be struck individually by the blow of a hammer or the like.

The invention includes an elongated rectangular frame which includes a longitudinal channel or slot for receiving the character stamps. A series of transverse holes formed in the frame above the channel provides access for a punch or drift pin which can be inserted into a hole above a stamp and struck to imprint the character into a metal surface over which the frame is positioned. To retain the stamps within the channel, each stamp has a groove or slot formed in a face thereof which can be aligned with like grooves formed in the remaining stamps within the frame. Holes formed in plates which define opposed ends of the frame are aligned with the grooves, and a wire or rod is inserted through the opposed holes, and through the aligned grooves in the stamps to retain the stamps within the frame while providing sufficient up and down movement relative thereto to allow each stamp to penetrate the surface of the article to be imprinted. To retain the frame in position on a surface, a support assembly is attached to each of the opposed ends of the frame, the support assemblies each having a pair of magnets attached thereto spaced apart on either side of the longitudinal axis of the frame. The angular position of each of the four magnets thus provided is adjustable so that they can accommodate flat or curved surfaces to position the frame so that the imprinting surfaces of the stamps retained within the frame are in contact with or in close proximity to the surface to be imprinted, and to maintain the desired position of the frame while each stamp is struck.

Also included as part of the invention is a punch holder which enables a worker to keep his hands away from the punch when he positions the punch in the holes above the stamps and strikes the punch with a hammer to imprint each stamp.

DESCRIPTION OF THE PREFERRED EMBODIMENT

Figure 1:
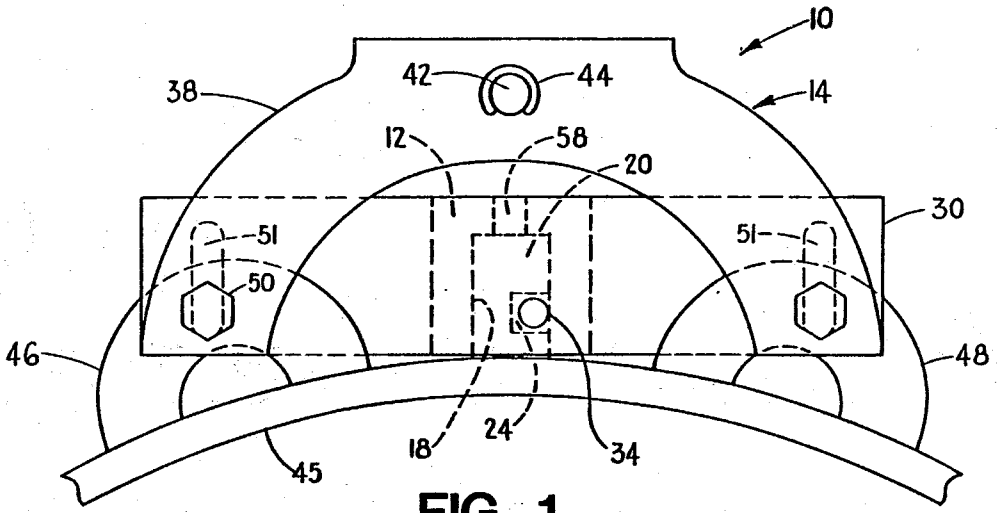
FIG. 1 is a side elevation view of the invention.

Referring to the drawings, there is illustrated a stamp holder 10 comprising an elongated frame 12, a first support assembly 14 attached to one end of the frame, and a second support assembly 16 attached to the opposite end of the frame.

Figure 2:
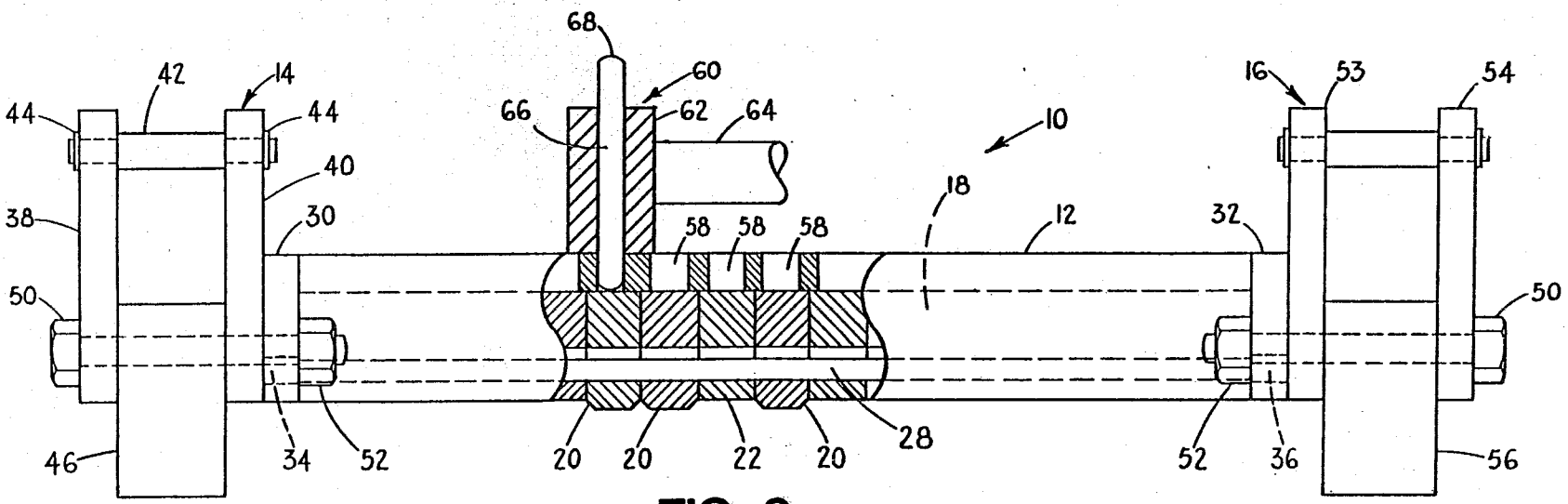
FIG. 2 is a front elevation view of the invention, with parts shown in section.
Figure 3:
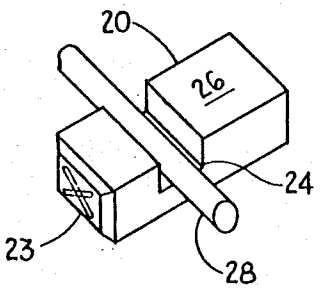
FIG. 3 is a perspective view of a stamp shown in relation to a retaining member of the invention.

Referring particularly to FIG. 2, the frame 12 is rectangular in cross-section, having a rectangular slot or channel 18 formed in the underside thereof along its longitudinal axis. One or more stamp members 20, or spacers 22 are received within the channel with their imprinting faces 23 extending outward from the channel, the depth of the channel being essentially equal to the height of each stamp.

The stamps can be standard metal stamps used for punching into metal surfaces, which have been modified by forming a groove 24 in a vertical face 26 thereof. The stamps 20 and appropriate spacers, also grooved, are placed in the frame 12 with the grooves 24 aligned, as shown in FIG. 2.

The frame 12 has transverse mounting plates 30 and 32 welded or otherwise attached to the ends thereof, each plate having a hole 34 and 36 respectively, formed therein in alignment with the grooves 24 formed in the stamps and spacers. To retain the stamps and spacers within the frame, a wire or rod 28 is inserted through one of the holes 34 or 36, through the grooves 24 and through the other hole. The wire or rod 28 is somewhat smaller in diameter than the width of the grooves 24 to permit each stamp to move downward relative to the remaining stamps when it is struck to enable it to penetrate the metal surface being imprinted.

The support assemblies 14 and 16, are substantially identical, and only one will be described in detail herein. The assembly 14 comprises a first inverted, substantially U-shaped member 38, and a second essentially identical member 40 separated at the base of the U by a shouldered pin 42 received between the members and retained thereto by means of retaining rings 44.

To retain the holder 10 in position on the surface of a steel pipe 45 or the like, permanent magnets 46 and 48 are received between the spaced apart legs of the U-shaped members and retained thereto by means of bolts 50 received through the U-shaped members and through holes formed in the magnets. The bolts 50 also extend through slots 51 formed through the plate 30 to adjustably attach support assembly 14 to the frame member 12, and are retained by nuts 52 threaded thereon. As indicated above, the other support assembly 16 is essentially identical, including U-shaped members 53 and 54 and a pair of magnets received therebetween, only one of which 56 is visible in FIG. 2.

To provide access for a punch with which to strike each of the stamps 20, a plurality of holes 58 are formed in the frame 12 above the channel 18, with the holes spaced along the channel so that a hole will overlay each of the stamps placed within the channel.

To facilitate imprinting the characters into the metal surface, the invention also provides a punch holder 60 comprising a cylindrical member 62 to which a handle 64 is welded or otherwise attached. A punch or drift pin 66 can be placed within a bore through the cylindrical member and into a hole 58 to contact a stamp 20. The upper end 68 of the punch can then be struck by a hammer or the like while the punch holder is held in position by holding the remote end (not shown) of the handle 64. By using the holder, a worker will not have his hand in a position where it can be inadvertently struck by the hammer.

When a set of identifying characters is to be punched into a steel pipe 45, the combination of stamps and spacers desired is placed in the channel 18 with the imprinting faces 23 of the stamps 20 facing downward as shown in FIG. 2, and the grooves 24 aligned. The rod 28 is then inserted through one of the holes 34 or 36, through the grooves 24, and through the other hole. The nuts 52 are then loosened slightly while the holder 10 is positioned over the portion of the pipe to be imprinted, whereupon the magnets are positioned as shown in FIG. 1 to place the frame 12 in a position wherein the imprinting faces 23 of the stamps 20 are in contact with the surface of the pipe. The nuts 52 can then be tightened, and the holder 10 will be held in the desired position by the magnets. The punch holder 60 is then placed over a stamp, the pin 66 inserted through the holder and into a hole 58, and the pin struck by hammer to imprint a character formed on the stamp into the surface of the pipe or other surface to be imprinted. The punching process is then repeated for each stamp.

It can be appreciated that while the holder 10 is illustrated as being used to imprint the curved outer surface of a pipe, it will function equally well on flat or irregular surfaces by adjusting the position of the four magnets relative to the U-shaped members 38, 40 and 53, 54.

Variations of the present invention will be apparent to those having ordinary skill in the art and the invention is limited only by the spirit and scope of the following claims.

I claim:

1. Apparatus for holding a plurality of stamp members for individually stamping identifying characters of a permanent nature into a tubular metal surface, comprising an elongated frame substantially rectangular in cross-section and having a channel formed in the underside thereof for receiving said stamp members, each of said stamp members comprising a substantially rectangular member having an imprinting character formed on an end face thereof and a transverse groove formed across a side face thereof, and means extending through said groove for retaining said one or more stamp members within said channel while allowing individual movement of each stamp member to stamp the tubular metal surface; said frame having a plurality of holes formed therein opposite said channel and aligned therewith; first and second plates attached to opposed ends of said frame, first and second support assemblies attached to said first and second plates respectively, a first pair of permanent magnets attached to said first support assembly, and a second pair of permanent magnets attached to said second support assembly; each of said support assemblies comprises a pair of spaced-apart, inverted, substantially U-shaped members attached to one of said plates, each of said permanent magnets being received between said U-shaped members and attached thereto adjacent the free ends of the legs thereof; each of said magnets is a horseshoe magnet attached to said U-shaped members by means permitting pivotal adjustment of said permanent magnets to allow said permanent magnets to define spaced leg members supporting said frame in a predetermined position on the tubular metal surface and substantially conforming to the shape of said tubular metal surface.

2. Apparatus as claimed in claim 1, wherein one of said plurality of holes formed in said frame is aligned with one of said stamp members, including in combination with said apparatus a cylinder having an elongated handle attached thereto, and having a through bore formed along its longitudinal axis; and a punch member extending through said bore, said cylinder being positionable over each of said holes formed in said frame with one end of said punch member extending into said hole and in contact with a stamp member and the other end of said punch member protruding from said cylinder, whereby said protruding end of said punch member can be struck to cause the character formed on said stamp member to be imprinted into a surface with which said frame is in contact.

3. Apparatus as claimed in claim 2, wherein said means for retaining said one or more stamp members comprising a rod received through holes formed in said plate members and through the groove formed in each of said one or more stamp members.

4. Apparatus as claimed in claim 3, in which each of said magnets is attached to said U-shaped members by means of a bolt extending through holes formed through said magnet and through said U-shaped member, said bolts also extending through holes formed through said plates to attach said support assemblies to said plates.

5. Apparatus as claimed in claim 3, in which said bolts are received in slots formed in said plates to permit adjustment of the position of said support assemblies relative to said plates.

* * * * *